US010290209B2

(12) United States Patent
Larcher et al.

(10) Patent No.: US 10,290,209 B2
(45) Date of Patent: May 14, 2019

(54) METHOD FOR OPERATING A SENSOR DEVICE, AND SENSOR DEVICE

(71) Applicant: Robert Bosch GmbH, Stuttgart (DE)

(72) Inventors: Nils Larcher, Tuebingen (DE); Fernando Suarez Lainez, Reutlingen (DE); Hannes Wolf, Dusslingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/544,269

(22) PCT Filed: Jan. 27, 2016

(86) PCT No.: PCT/EP2016/051643
§ 371 (c)(1),
(2) Date: Jul. 18, 2017

(87) PCT Pub. No.: WO2016/131621
PCT Pub. Date: Aug. 25, 2016

(65) Prior Publication Data

US 2018/0268688 A1 Sep. 20, 2018

(30) Foreign Application Priority Data

Feb. 17, 2015 (DE) ..... 10 2015 202 784

(51) Int. Cl.
*G08G 1/042* (2006.01)
*G08G 1/14* (2006.01)
*G08G 1/017* (2006.01)

(52) U.S. Cl.
CPC ..... *G08G 1/042* (2013.01); *G08G 1/017* (2013.01); *G08G 1/14* (2013.01); *G08G 1/146* (2013.01); *G08G 1/147* (2013.01)

(58) Field of Classification Search
CPC ..... G08G 1/02; G08G 1/04; G08G 1/042; G08G 1/14; G08G 1/142
See application file for complete search history.

(56) References Cited

U.S. PATENT DOCUMENTS

2017/0168155 A1* 6/2017 Richard ..... G01S 13/86
2017/0249626 A1* 8/2017 Marlatt ..... G01V 3/081

FOREIGN PATENT DOCUMENTS

EP 2905765 A1 8/2015
JP S4987034 A 8/1974
(Continued)

OTHER PUBLICATIONS

International Search Report dated Apr. 4, 2016, of the corresponding International Application PCT/EP2016/051643 filed Jan. 27, 2016.

*Primary Examiner* — Hongmin Fan
(74) *Attorney, Agent, or Firm* — Norton Rose Fulbright US LLP; Gerard Messina

(57) ABSTRACT

A method for operating a sensor device for detecting an object. including measuring a magnetic field using a magnetic field sensor to ascertain a measured value, the sensor unit being deactivated during the measurement, computing a first distance of the measured value from a first reference measured value that corresponds to a magnetic field when a measuring range is free of an object, computing a second distance of the measured value from a second reference measured value that corresponds to a magnetic field when an object is situated in the measuring range, activating the deactivated sensor unit as a function of the computed distances, carrying out a propagation time measurement using the activated sensor unit to ascertain sensor data that correspond to the propagation time measurement, and ascertaining, based on the sensor data, whether an object is situated in the surroundings of the sensor device.

18 Claims, 2 Drawing Sheets

(56) References Cited

FOREIGN PATENT DOCUMENTS

| | | | |
|---|---|---|---|
| JP | H1194566 | A | 4/1999 |
| JP | 2001175988 | A | 6/2001 |
| JP | 2002350103 | A | 12/2002 |
| WO | 2010069002 | A1 | 6/2010 |

* cited by examiner

METHOD FOR OPERATING A SENSOR DEVICE, AND SENSOR DEVICE

FIELD

The present invention relates to a method for operating a sensor device for detecting an object. Moreover, the present invention relates to a sensor device for detecting an object. Furthermore, the present invention relates to a computer program.

BACKGROUND INFORMATION

Determining the capacity utilization of parking garages and commercial parking facilities is very important for their operation, and for traffic management in cities. For this reason, sensors that transmit the status of the parking facility to a control center are used for monitoring parking facilities. Detecting the status normally takes place either via magnetic field sensors, cameras, or emitting sensors such as ultrasonic sensors or radar sensors.

Depending on the system, the sensors are either fixedly connected to a power supply network or a data network, which means a high level of complexity for the installation, or are battery-operated and communicate wirelessly with the control center via radio. The challenge for the wireless systems is in particular to maximize the service life, which is limited by the battery capacity.

SUMMARY

An object underlying the present invention may therefore be regarded as providing an efficient system that allows electrical energy consumption of a sensor device to be reduced.

Advantageous embodiments of the present invention are described herein.

According to one aspect, a method for operating a sensor device for detecting an object is provided, the sensor device including a magnetic field sensor and a sensor unit that is designed for a propagation time measurement, including the following steps:

measuring a magnetic field in the surroundings of the sensor device with the aid of the magnetic field sensor in order to ascertain a measured value that corresponds to the measured magnetic field, the sensor unit being deactivated during the measurement of the magnetic field, computing a first distance of the measured value from a first reference measured value that corresponds to a magnetic field when a measuring range of the magnetic field sensor is free of an object, computing a second distance of the measured value from a second reference measured value that corresponds to a magnetic field when an object is situated in the measuring range of the magnetic field sensor, activating the deactivated sensor unit as a function of the computed distances, carrying out a propagation time measurement in the surroundings of the sensor device with the aid of the activated sensor unit in order to ascertain data that correspond to the propagation time measurement, ascertaining, based on the sensor data, whether an object is situated in the surroundings of the sensor device.

According to another aspect, a sensor device for detecting an object is provided which includes:

a magnetic field sensor, a sensor unit that is designed for a propagation time measurement, a control device for controlling the magnetic field sensor and the sensor unit, and a processor, the control device being designed for controlling the magnetic field sensor in such a way that a magnetic field in the surroundings of the sensor device is measured with the aid of the magnetic field sensor in order to ascertain a measured value that corresponds to the measured magnetic field, the sensor unit being deactivated during the measurement of the magnetic field, the processor being designed for computing a first distance of the measured value from a first reference measured value that corresponds to a magnetic field when a measuring range of the magnetic field sensor is free of an object, the processor being designed for computing a second distance of the measured value from a second reference measured value that corresponds to a magnetic field when an object is situated in the measuring range of the magnetic field sensor, the control device being designed for activating the deactivated sensor unit as a function of the computed distances, and controlling it in such a way that a propagation time measurement is carried out in the surroundings of the sensor device with the aid of the activated sensor unit in order to ascertain the sensor data that correspond to the propagation time measurement, the processor being designed for ascertaining, based on the sensor data, whether an object is situated in the surroundings of the sensor device.

According to another aspect, a computer program is provided which includes program code for carrying out the method according to the present invention when the computer program is executed on a computer.

The present invention thus includes in particular, and among other things, activating the sensor unit of the sensor device only when the measurement of the magnetic field sensor is not sufficient to state with a predetermined likelihood whether or not an object is situated in the surroundings of the sensor device. Thus, due to the sensor unit not being activated constantly, i.e., continuously, in order to detect the surroundings of the sensor device, electrical energy consumption of the sensor device may advantageously be reduced. This is in comparison to a sensor device that includes a magnetic field sensor and a radar unit or an ultrasonic unit, whereby the radar unit or the ultrasonic unit as well as the magnetic field sensor carry out a detection of the surroundings continuously, or at least at predefined intervals.

In addition, a service life that is limited by a battery capacity may thus advantageously be maximized when the sensor device includes such a battery, or in general a supply of electrical power, for supplying electrical energy. The sensor device may thus advantageously also be used in surroundings that do not include a hard-wired power supply network for supplying energy. Complexity of an installation of the sensor device may thus be reduced.

Computing the corresponding distances of the measured value from the two reference measured values yields in particular the technical advantage that it may thus be ascertained whether a measured value is closer to the first or to the second reference measured value, i.e., whether the measured value more closely resembles the first or the second reference measured value. The closer that a measured value is to a certain reference measured value, generally the greater the likelihood in particular that no object is situated in the measuring range of the magnetic field sensor when the measured value is closer to the first reference measured value, or that an object is situated in the measuring range of the magnetic field sensor when the measured value is closer to the second reference measured value.

The wording "free of an object" means in particular that no object is situated in the measuring range of the magnetic field sensor.

However, if the ascertained distances are such that a decision cannot be reliably made as to whether or not an object is situated in the measuring range of the magnetic field sensor based solely on the measured value, the deactivated sensor unit is activated and a propagation time measurement is carried out. The sensor unit may thus generally remain deactivated. The decision of whether or not an object is situated in the measuring range of the magnetic field sensor may be made based solely on the magnetic field measurement. The sensor unit is activated only in situations in which the magnetic field measurement is not sufficient to reliably detect whether or not an object is situated in the surroundings.

In one specific embodiment, it is provided that the sensor unit includes a radar unit and/or an ultrasonic unit.

A radar unit within the meaning of the present invention includes in particular a radar sensor for detecting a radar beam. The radar unit is designed in particular for emitting a radar beam, it being possible to detect a reflected radar beam with the aid of the radar sensor. Thus, the radar unit includes in particular a radar emitter. In particular, according to one specific embodiment the radar unit is designed for measuring a distance between the radar unit and an object that is situated in front of the radar unit, i.e., in the measuring range of the radar unit, in particular of the radar sensor. This is carried out with the aid of a propagation time measurement of the emitted radar beam. A propagation time measurement in conjunction with the radar unit may be referred to in particular as a radar measurement. The sensor data may then be referred to in particular as radar data.

An ultrasonic unit within the meaning of the present invention includes in particular an ultrasonic sensor for detecting ultrasound. The ultrasound is designed in particular for emitting ultrasound, it being possible to detect reflected ultrasound with the aid of the ultrasonic sensor. The ultrasonic unit thus includes in particular an ultrasound emitter. In particular, according to one specific embodiment the ultrasonic unit is designed for measuring a distance between the ultrasonic unit and an object that is situated in front of the ultrasonic unit, i.e., in the measuring range of the ultrasonic unit, in particular of the ultrasonic sensor. This is carried out with the aid of propagation time measurement of the emitted ultrasound. A propagation time measurement in conjunction with the ultrasonic unit may be referred to in particular as an ultrasonic measurement. The sensor data may then be referred to in particular as ultrasonic data.

According to one specific embodiment, the sensor unit is designed for emitting a signal, for example an ultrasonic signal and/or a radar signal, and detecting or measuring a reflected signal, for example a reflected ultrasonic signal and/or a reflected radar signal, so that a propagation time measurement of the signal may be carried out. The sensor unit thus includes in particular emitting sensors, which generally may also be referred to as active sensors, for example an active radar sensor and/or an active ultrasonic sensor. An active sensor is thus understood to mean a sensor that actively reflects a signal and that may measure a reflected signal. The radar unit thus includes an active radar sensor, for example, i.e., a radar-emitting radar sensor. The ultrasonic unit thus includes an active ultrasonic sensor, for example, i.e., an ultrasound-emitting ultrasonic sensor.

In contrast, a magnetic field sensor is a passive sensor, since it emits no signal, and instead merely passively measures the magnetic field in its vicinity or surroundings.

The sensor unit is thus designed in particular for measuring a distance between it and an object situated in the measuring range of the sensor unit. This is carried out with the aid of a propagation time measurement. Since a signal, for example radar and/or ultrasound, must be emitted for the propagation time measurement, the sensor unit may also be referred to as an emitting sensor unit or as an active sensor unit.

The fact that the sensor unit is designed for a propagation time measurement means in particular that the sensor unit is designed for carrying out a propagation time measurement. This means that the sensor unit carries out a propagation time measurement, for example to carry out a distance between it and an object situated in the measuring range of the sensor unit.

A propagation time measurement includes in particular emitting or sending a signal and detecting or measuring a reflected signal. In particular, a propagation time measurement includes a measurement of the time between the emitting or the sending of the signal and the detecting or the measuring of the reflected signal. According to one specific embodiment, it is provided that, based on the propagation time measurement, a distance between the sensor unit and an object situated in the measuring range of the sensor unit is determined or ascertained. According to one specific embodiment, it is ascertained, based on the propagation time measurement, in particular based on the determined distance, whether or not an object is situated in the surroundings of the sensor device. Sensor data thus include in particular data corresponding to the detected or measured reflected signal.

When specific reference is made in this description to a radar unit and a radar measurement, this is not to be construed as limiting. Rather, generally the sensor unit and the propagation time measurement are also preferably included. Similarly, the ultrasonic unit is preferably to be included instead of or in addition to the radar unit.

According to one specific embodiment, it is provided that the magnetic field sensor is deactivated after the magnetic field is measured. This yields in particular the technical advantage that energy consumption of the sensor device may be even further reduced. This is due to the fact that electrical energy consumption of the magnetic field sensor is advantageously further reduced due to deactivating the magnetic field sensor.

According to one specific embodiment, it is provided that the sensor unit is deactivated after the propagation time measurement is carried out. This advantageously yields the technical advantage that energy consumption of the sensor device may be even further reduced. This is due to the fact that electrical energy consumption of the sensor unit is advantageously further reduced due to deactivating the sensor unit.

This means in particular that the magnetic field sensor is deactivated after the surroundings are detected with the aid of the magnetic field sensor, i.e., after the magnetic field measurement.

This means in particular that the sensor unit is deactivated after the surroundings are detected with the aid of the sensor unit, i.e., after the propagation time measurement.

Within the meaning of the present invention, a deactivation includes in particular the magnetic field sensor and the sensor unit being placed in a standby or ready mode. In particular, within the meaning of the present invention, a deactivation includes interrupting a power supply, or in general an electrical energy supply, for the magnetic field sensor and the sensor unit. This means in particular that a deactivation may include completely disconnecting the magnetic field sensor and the sensor unit from an electrical energy supply.

Within the meaning of the present invention, an activation includes in particular "waking up" the magnetic field sensor and the sensor unit from a sleep mode or a standby mode or ready mode. In particular, an activation includes reconnecting the magnetic field sensor and the sensor unit to an electrical energy supply when the magnetic field sensor and the sensor unit have previously been disconnected from same.

According to one specific embodiment, it is provided that a first magnetic field measurement is carried out with the aid of the magnetic field sensor while a measuring range of the magnetic field sensor is free of an object in order to ascertain the first reference measured value, and a second magnetic field measurement is carried out with the aid of the magnetic field sensor while an object is situated in the measuring range of the magnetic field sensor in order to ascertain the second reference measured value.

This yields in particular the technical advantage that the reference measured values may be ascertained, for example, during operation of the sensor device. Specific ambient conditions that are present may thus advantageously be taken into account. In particular, an adaptation to changing external influences may thus advantageously be made. Such external influences include, for example, weather conditions or presence of magnetic objects in the vicinity of the magnetic field sensor.

According to one specific embodiment, it is provided that the computed distances are normalized.

In another specific embodiment, it is provided that the computed distances are normalized, a difference between the two normalized distances being computed, the difference between the two normalized distances being compared to a sensor unit activation threshold value, and the deactivated sensor unit being activated based on the comparison to the sensor unit activation threshold value. In the case of a radar unit, the sensor unit activation threshold value is a radar unit activation threshold value. In the case of an ultrasonic unit, the sensor unit activation threshold value is an ultrasonic unit activation threshold value.

This yields in particular the technical advantage that it may be efficiently recognized when the deactivated sensor unit has to be activated.

The normalization yields the advantageous effect that the sensor device may have the same behavior in different surroundings. According to one specific embodiment, the computation for the normalization is as follows:

$$\text{Normalized distance}=\text{distance}/\text{normalization factor},$$

where the normalization factor is in particular selected in an application-specific manner. In this context, "application-specific" means in particular that different normalization factors are selected, depending on the intended application of the sensor device. When the sensor device is used, for example, for identifying or detecting an occupancy status of a parking position, a different normalization factor is selected than when the sensor device is used for measuring a traffic density.

In another specific embodiment, it is provided that the normalized distances are compared to a threshold value, it being ascertained, based on the comparison to the threshold value, whether an object is situated in the surroundings of the sensor device.

This yields in particular the technical advantage that it may be efficiently ascertained whether an object is situated in the surroundings of the sensor device, in particular based on the magnetic field measurement.

In another specific embodiment, it is provided that when it is ascertained, based on the sensor data, that an object is situated in the surroundings of the sensor device, a magnetic field measurement is carried out with the aid of the magnetic field sensor in order to update the second reference measured value, and when it is ascertained, based on the sensor data, that the surroundings of the sensor device are free of an object, a magnetic field measurement is carried out with the aid of the magnetic field sensor in order to update the first reference measured value.

This yields in particular the technical advantage that results of the propagation time measurement may be efficiently and effectively used for updating the two reference measured values. This means in particular that after the propagation time measurement, the magnetic field sensor carries out a magnetic field measurement in order to ascertain a corresponding measured value. Since, due to the propagation time measurement, it is known whether or not an object is situated in the surroundings, this measured value may then be defined either as the first or as the second reference measured value, depending on whether the propagation time measurement has shown whether or not an object is situated in the surroundings.

This means in particular that when the propagation time measurement has shown that an object is situated in the surroundings of the sensor device, the measured value of the magnetic field measurement is defined as the second reference measured value. This means that the second reference measured value is then updated here. Similarly, the measured value of the magnetic field measurement is defined as the first reference measured value when the propagation time measurement has shown that no object is situated in the surroundings of the sensor device. This means that the first reference measured value is then updated here, based on the propagation time measurement.

According to another specific embodiment, it is provided that a result of ascertaining whether an object is situated in the surroundings of the sensor device is transmitted via a communications network.

This yields in particular the technical advantage that the result may also be provided remote from the sensor device. For example, the result is transmitted via a communications network.

A communications network includes in particular a WLAN and/or a mobile communications network.

According to one specific embodiment, it is provided in particular that a communication becomes or is encrypted via the communications network.

According to one specific embodiment, it is provided that an instantaneous result of ascertaining whether an object is situated in the surroundings is compared to a previous result of a chronologically earlier ascertainment of whether an object is situated in the surroundings, the instantaneous result being transmitted via a communications network only when there is a difference between the instantaneous result and the previous result.

This yields in particular the technical advantage that electrical energy consumption of the sensor device may be even further reduced. This is due to the fact that the instantaneous result is transmitted via the communications network only when a difference between the instantaneous result and the previous result has been determined. In particular, this advantageously yields the effect that a data bandwidth that is present may be efficiently utilized.

Within the meaning of the present invention, a result includes in particular an object having been detected, i.e., an object being present in the surroundings, i.e., being situated in the surroundings. A result includes in particular no object having been detected, i.e., no object being present in the surroundings.

The previous result, analogously to the instantaneous result, has been ascertained according to the method according to the present invention or with the aid of the sensor device according to the present invention. This means that the surroundings of the sensor device have been detected at a chronologically earlier point in time to ascertain whether or not an object is situated in the surroundings.

According to another specific embodiment, it is provided that the sensor device is situated in the surroundings of a parking position, so that, based on a result of ascertaining whether an object is situated in the surroundings of the sensor device, it is ascertained whether the parking position is available or occupied.

This yields in particular the technical advantage that it may be efficiently and effectively ascertained whether the parking position is available or occupied. An available parking position refers in particular to a parking position in which no vehicle is parked. An occupied parking position refers in particular to a parking position in which a vehicle is parked.

In this specific embodiment, the sensor device may thus be referred to as a sensor device for ascertaining an occupancy status of a parking position. The object which is to be or may be detected here is thus in particular a vehicle. The sensor device may then be referred to, for example, as a sensor device for detecting a vehicle.

In one specific embodiment, it is provided that the control device is designed for controlling the magnetic field sensor in such a way that a first magnetic field measurement is carried out with the aid of the magnetic field sensor while a measuring range of the magnetic field sensor is free of an object in order to ascertain the first reference measured value, and the control device is designed for controlling the magnetic field sensor in such a way that a second magnetic field measurement is carried out with the aid of the magnetic field sensor while an object is situated in the measuring range of the magnetic field sensor in order to ascertain the second reference measured value.

According to one specific embodiment, it is provided that the processor is designed for normalizing the computed distances.

In another specific embodiment, it is provided that the processor is designed for normalizing the computed distances, computing a difference between the two normalized distances, and comparing the difference between the two normalized distances to a sensor unit activation threshold value, the control device being designed for activating the deactivated sensor unit based on the comparison to the sensor unit activation threshold value.

According to another specific embodiment, it is provided that the processor is designed for comparing the normalized distances to a threshold value and ascertaining, based on the comparison to the threshold value, whether an object is situated in the surroundings of the sensor device.

According to yet another specific embodiment, it is provided that the control device is designed for controlling the magnetic field sensor in such a way that a magnetic field measurement is carried out with the aid of the magnetic field sensor in order to update the second reference measured value when, based on the sensor data, it is ascertained that an object is situated in the surroundings of the sensor device, and the control device is designed for controlling the magnetic field sensor in such a way that a magnetic field measurement is carried out with the aid of the magnetic field sensor in order to update the first reference measured value when, based on the sensor data, it is ascertained that the surroundings of the sensor device are free of an object.

According to yet another specific embodiment, it is provided that a communication interface is provided which is designed for transmitting via a communications network a result of ascertaining whether an object is situated in the surroundings of the sensor device.

In another specific embodiment, it is provided that an electrical energy supply is provided for supplying electronic elements of the sensor device with electrical energy. This yields in particular the technical advantage that a self-sufficient supply of energy to the sensor device is provided. Electronic elements of the sensor device are in particular the sensor unit, in particular the radar unit and/or in particular the ultrasonic unit, the magnetic field sensor, the control device, the processor, and possibly in particular the communication interface. According to one specific embodiment, the electrical energy supply includes one or multiple batteries. In another specific embodiment, the electrical energy supply includes one or multiple rechargeable batteries.

In another specific embodiment, it is provided that the processor is designed for ascertaining whether a parking position is available or occupied, based on a result of ascertaining whether an object is situated in the surroundings of the sensor device.

According to one specific embodiment, it is provided that the object is a vehicle traveling on a road, or a container deposited in a container yard. This means in particular that the sensor device may be used for detecting or monitoring a traffic flow and/or a traffic density. In particular when the object is a container, an occupancy status of a container space may thus advantageously be identified or detected with the aid of the sensor device.

According to one specific embodiment, it is provided that the sensor device is configured or designed for executing or carrying out the method according to the present invention.

According to one specific embodiment, it is provided that the method according to the present invention operates the sensor device according to the present invention.

According to one specific embodiment, the processor and the control device are included in a microcontroller.

Device features analogously result from the corresponding method features, and vice versa. This means in particular that features, technical advantages, and statements concerning the sensor device analogously result from corresponding statements, features, and advantages concerning the method, and vice versa. This means in particular that technical functionalities of the method result from the device, and vice versa.

The present invention is explained in greater detail below with reference to preferred exemplary embodiments.

DETAILED DESCRIPTION OF EXAMPLE EMBODIMENTS

Figure 1:
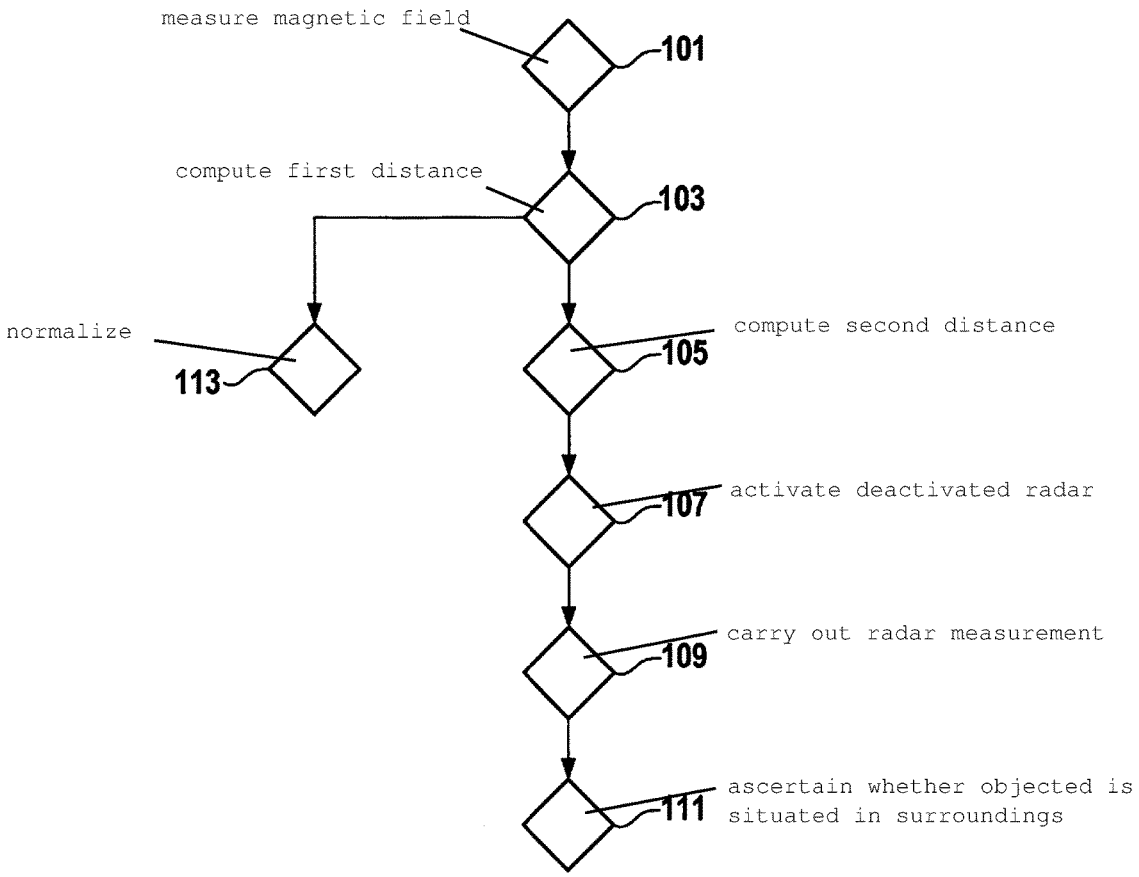
FIG. 1 shows a flow chart of a method for operating a sensor device.

FIG. 1 shows a flow chart of a method for operating a sensor device for detecting an object.

The sensor device includes a magnetic field sensor and a radar unit. In particular the following steps are provided:

- measuring 101 a magnetic field in the surroundings of the sensor device with the aid of the magnetic field sensor in order to ascertain a measured value that corresponds to the measured magnetic field, the radar unit being deactivated during the measurement of the magnetic field,
- computing 103 a first distance of the measured value from a first reference measured value that corresponds to a magnetic field when a measuring range of the magnetic field sensor is free of an object,
- computing 105 a second distance of the measured value from a second reference measured value that corresponds to a magnetic field when an object is situated in the measuring range of the magnetic field sensor,
- activating 107 the deactivated radar unit as a function of the computed distances,
- carrying out 109 a radar measurement in the surroundings of the sensor device with the aid of the activated radar unit in order to ascertain radar data that correspond to the radar measurement,
- ascertaining 111, based on the radar data, whether an object is situated in the surroundings of the sensor device.

When it is determined, based on the computed distances, that the deactivated radar unit does not have to be activated, it is provided to normalize the computed distances according to a step 113, the normalized distances being compared to a threshold value, it being ascertained, based on the comparison to the threshold value, whether an object is situated in the surroundings of the sensor device. This means in particular that it is ascertained according to step 113, based solely on the magnetic field measurement, whether an object is situated in the surroundings of the sensor device. Thus, in this case the radar unit does not have to be activated. This yields an advantageous effect for reduced energy consumption of the sensor device.

Figure 2:
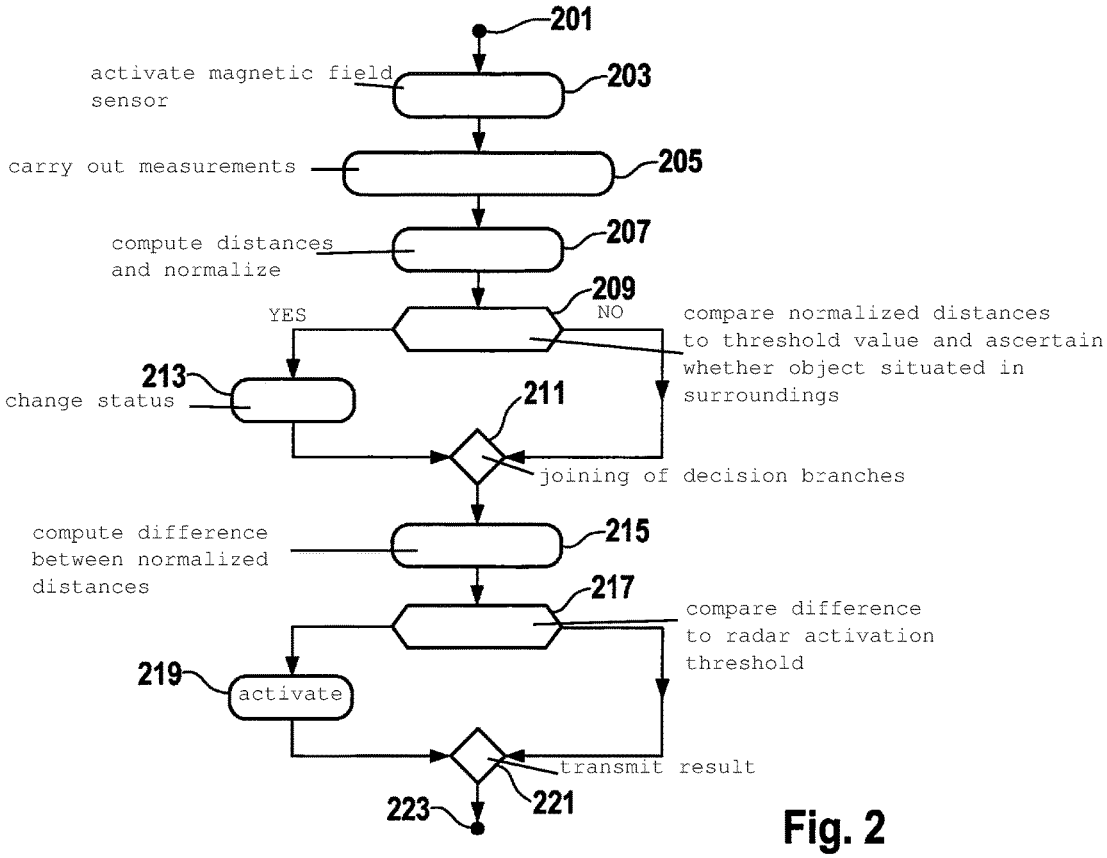
FIG. 2 shows a flow chart of another method for operating a sensor device.

FIG. 2 shows a flow chart of another method for operating a sensor device for detecting an object.

The sensor device includes a magnetic field sensor and a radar unit. In particular, it is provided to detect whether a parking position is occupied or available with the aid of the sensor device.

The method starts in a step 201, in which a magnetic field sensor is activated for the purpose of a magnetic field measurement, and a radar unit is deactivated if it is not already deactivated.

It is provided that a first magnetic field measurement is carried out with the aid of the magnetic field sensor in a step 203 while a measuring range of the magnetic field sensor is free of an object in order to ascertain the first reference value. In particular, it is provided that a second magnetic field measurement is carried out with the aid of the magnetic field sensor according to step 203 while an object is situated in the measuring range of the magnetic field sensor in order to ascertain the second reference measured value. This means that it is provided according to step 203 that the two reference measured values are initialized. This may be carried out during initial assembly, for example. This initialization of the reference measured values according to step 203 is carried out in particular during operation of the sensor device.

It is provided that a magnetic field in the surroundings of the sensor device is measured with the aid of the magnetic field sensor in a step 205 in order to ascertain a measured value that corresponds to the measured magnetic field, the radar unit being deactivated during the measurement of the magnetic field.

It is provided that a first distance of the measured value from the first reference measured value is computed in a step 207. In particular, it is provided that a second distance of the measured value from the second reference measured value is computed in step 207. It is also provided that the computed distances are normalized according to step 207.

It is provided that the normalized distances are compared to a threshold value in a step 209. It is also provided in step 209 that it is ascertained, based on the comparison to the threshold value, whether an object is situated in the surroundings of the sensor device. If no object is situated in the surroundings of the sensor device, the method continues to block 211. If an object is situated in the surroundings of the sensor device, a status is changed according to a step 213. This status indicates whether or not the sensor device has detected an object, in particular, whether a parking position is available or occupied. The statuses describe whether or not an object is present in the surroundings of the sensor device. The change has an effect on the operation of the sensor device, for example, such that in each case the "fingerprint" associated with the status is updated. Otherwise, the change from one status to the other is binary, and there is no transition phase. The status may be implemented, for example, by an internal status indicator, which may be referred to as a flag, for example, and which may assume the values 0 (no object detected) and 1 (object detected).

The method then continues to block 211. According to FIG. 2, block 211 is not an independent function block and thus has no independent function. Block 211 has been inserted into the flow chart solely for the sake of clarity to be able to better illustrate the joining of the two decision branches (object present and no object present).

From there, the method continues to step 215, in which a difference between the two normalized distances is computed.

It is provided that the difference between the two normalized distances is compared to a radar activation threshold value in a step 217.

Based on the comparison to the radar activation threshold value, the deactivated radar unit is either activated according to a step 219, or is not activated. Thus, if the radar unit is activated according to step 219, a radar measurement is carried out in the surroundings of the sensor device with the aid of the activated radar unit in order to ascertain radar data that correspond to the radar measurement. It is then further provided that, in particular based on the radar data, it is ascertained according to step 219 whether an object is situated in the surroundings of the sensor device.

The method subsequently continues to step 221, in which it may be provided, for example, to transmit a result of the ascertainment via a communications network. The method then ends in a step 223, according to which it may be provided that the sensor device is shifted into a sleep mode. In particular, the magnetic field sensor is deactivated and the radar unit is deactivated.

According to another specific embodiment, it is provided in particular that the method is continued or restarted in step 201 or 203 or 205 after a predetermined time or at predetermined intervals.

Figure 3:
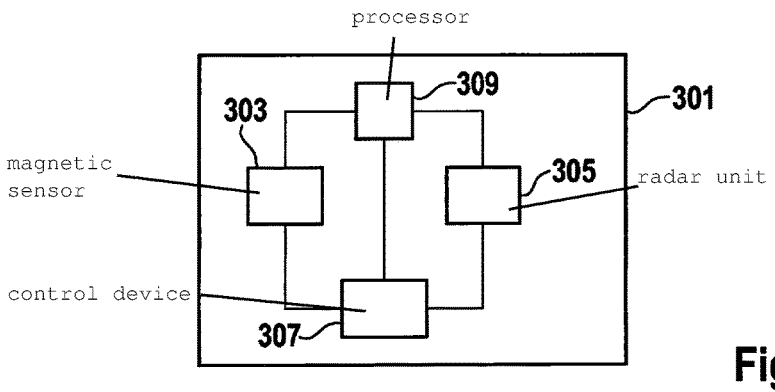
FIG. 3 shows a sensor device.

FIG. 3 shows a sensor device 301 for detecting an object. Sensor device 301 includes:

a magnetic field sensor 303, a radar unit 305, a control device 307 for controlling magnetic field sensor 303 and radar unit 305, and a processor 309, control device 307 being designed for controlling magnetic field sensor 303 in such a way that a magnetic field in the surroundings of sensor device 301 is measured with the aid of magnetic field sensor 303 in order to ascertain a measured value that corresponds to the measured magnetic field, radar unit 305 being deactivated during the measurement of the magnetic field, processor 309 being designed for computing a first distance of the measured value from a first reference measured value that corresponds to a magnetic field when a measuring range of magnetic field sensor 303 is free of an object, processor 309 being designed for computing a second distance of the measured value from a second reference measured value that corresponds to a magnetic field when an object is situated in the measuring range of magnetic field sensor 303, control device 307 being designed for activating deactivated radar unit 305 as a function of the computed distances, and controlling it in such a way that a radar measurement is carried out in the surroundings of sensor device 301 with the aid of activated radar unit 305 in order to ascertain radar data that correspond to the radar measurement, processor 309 being designed for ascertaining, based on the radar data, whether an object is situated in the surroundings of sensor device 301.

The present invention thus includes in particular, and among other things, the idea of providing an efficient way via which a service life of a sensor device, in particular a sensor device for detecting an occupancy status of a parking position, including a radar unit (and/or an ultrasonic unit, generally a sensor unit, that is designed for carrying out a propagation time measurement) and a magnetic field sensor, may be increased in that the activation of the radar unit (generally the sensor unit) in particular is a function of a signal of the magnetic field sensor. Power consumption is thus advantageously reduced while maintaining reliability of the recognition, since the radar unit (generally the sensor unit) is activated only when necessary. According to the present invention, an efficient algorithm is thus provided which decides, based on a small quantity of magnetic field measuring data, whether an activation of the sensor unit, in particular the radar unit and/or the ultrasonic unit, is necessary.

In accordance with the present invention, it is decided, based on the distance of a measuring point of the magnetic field measurement from reference measuring data, for example the reference measured values of an occupied status and an available status of a parking position, whether the sensor unit must be activated. The example embodiment according to the present invention, i.e., in particular the sensor device, has in particular the following advantages and technical features:

An increased service life of a battery due to an intelligent reduction in the activation of the radar unit, an extended maintenance interval, and reduced operating costs.

A recognition of the occupancy status of the parking position from an instantaneous and at least one previous measured value via the magnetic field sensor, when the radar unit is not needed.

A recognition of the occupancy status of the parking position from an instantaneous and at least one previous measured value, whether the activation of the radar unit is necessary.

A continuous, in particular independent and/or automatic, calibration of the reference data, i.e., the reference measured values, in order to advantageously adapt to changing surroundings, for example different installation sites, changing external influences due to weather conditions, and presence of magnetic objects in the vicinity of the sensor device.

A rapid automatic adaptation to temporary changes, for example because a subway train is traveling beneath the parking position.

The sensor device, in particular the sensor device for parking facility monitoring, i.e., for detecting an occupancy status of a parking position, includes in particular the following components:

A magnetic field sensor that measures, periodically, for example, a magnetic field acting on it.

A radar unit that measures, for example, a distance from an object situated in front of the radar unit. In general, a sensor unit may be provided that may measure a distance from an object situated in front of the sensor unit, in particular with the aid of a propagation time measurement.

A microcontroller that executes software which controls the magnetic field sensor and the radar unit. For this purpose, in particular the magnetic field sensor and the radar unit and a communication interface that is possibly present, which may also be referred to as a wireless interface in the case of wireless communication, may be controlled. In particular, the software includes the algorithm according to the present invention, provided here, which decides when the radar unit is to be activated.

A communication interface via which the recognition is reported to a higher-level unit, for example an external server, i.e., a remote server.

An electrical energy supply, for example a battery, which supplies the electronic components, for example the magnetic field sensor, the radar unit, the microcontroller, and the wireless interface, with power, i.e., generally electrical energy.

According to one specific embodiment, it is provided that the magnetic field sensor is periodically activated in order to carry out a magnetic field measurement. It is thus advantageously possible to determine, via changes in the surrounding magnetic field, whether a vehicle, generally an object, is in the measuring range of the magnetic field sensor, for example above or next to the magnetic field sensor. However, it is possible that this magnetic field measurement may be disturbed by other external influences. According to the present invention, it is therefore provided to additionally use a radar unit. However, this radar unit generally consumes significantly more power than the magnetic field sensor. This power must generally be delivered or provided by the battery. This may make it uneconomical to periodically activate the radar unit, since either the battery service life is greatly reduced, or a response time of the sensor device is greatly increased.

These disadvantages are overcome in particular in that, according to the present invention, the radar unit is activated only when it is actually needed. According to one specific embodiment, it is provided in particular that of the measured sensor values of the magnetic field sensor, two depictions (fingerprints) are created and stored. These are thus the two reference measured values.

One fingerprint (first reference measured value) is created from the data of the vacant parking position. The other fingerprint (second reference measured value) is created from a parking position that is occupied.

According to one specific embodiment, it is provided that both fingerprints, i.e., both depictions or both reference measured values, are periodically updated during operation in order to advantageously adapt to changes in the measured magnetic field of the surroundings (for example, drift due to a temperature, presence of magnetic objects in the vicinity).

In order to now determine or detect an occupancy status of the parking position, the following is provided according to further specific embodiments:

A new measured value is preferably periodically recorded with the aid of the magnetic field sensor (see step 205 according to FIG. 2). Based on this measured value, the distances from the two fingerprints (i.e., from the two reference measured values) are computed and subsequently normalized (see step 207 according to FIG. 2). The normalized distances are compared to a threshold value (see step 209 according to FIG. 2). Depending on whether the normalized distances are in each case above or below the threshold value, it is decided whether the status has changed, or whether the old status is maintained. This means that, based on the comparison to the threshold value, it is decided whether or not an occupancy status of the parking position has changed (see step 213 according to FIG. 2).

In order to now decide whether the radar unit must be activated, according to one specific embodiment it is provided that the two normalized distances from the stored depictions are compared to one another (see steps 215 and 217 according to FIG. 2). If this difference between the two normalized distances is less than the radar activation threshold value, this means that no reliable decision can be made as to whether or not the occupancy status has changed. According to one specific embodiment, this means that it is provided that the radar unit is activated, in particular only briefly, for plausibility checking for a distance measurement. This means that the radar unit in particular is once again deactivated after the distance measurement.

According to one specific embodiment, it is subsequently provided that the result of the radar measurement is used for updating the fingerprint in question, i.e., either the first or the second reference measured value, in particular in that the magnetic field sensor carries out a new magnetic field measurement.

The above statements, in particular the statements made in conjunction with FIGS. 1, 2, and 3, similarly apply for sensor devices that generally include a sensor unit, in particular an ultrasonic unit. This means that in the above statements, an ultrasonic unit may be provided instead of or in addition to the radar unit. This means that in the above statements, a sensor unit may generally be provided that is designed for carrying out a propagation time measurement, i.e., a sensor unit that is designed for a propagation time measurement.

What is claimed is:

1. A method for operating a sensor device for detecting an object, the sensor device including a magnetic field sensor, and a sensor unit that is designed for a propagation time measurement, the method comprising:

measuring a magnetic field in surroundings of the sensor device using the magnetic field sensor to ascertain a measured value that corresponds to the measured magnetic field, the sensor unit being deactivated during the measurement of the magnetic field;

computing a first distance of the measured value from a first reference measured value that corresponds to a magnetic field when a measuring range of the magnetic field sensor is free of an object;

computing a second distance of the measured value from a second reference measured value that corresponds to a magnetic field when an object is situated in the measuring range of the magnetic field sensor;

activating the deactivated sensor unit as a function of the computed first distance and the computed second distance;

carrying out a propagation time measurement in the surroundings of the sensor device using the activated sensor unit to ascertain sensor data that correspond to the propagation time measurement; and ascertaining, based on the sensor data, whether an object is situated in the surroundings of the sensor device.

2. The method as recited in claim 1, wherein a first magnetic field measurement is carried out using the magnetic field sensor while a measuring range of the magnetic field sensor is free of an object to ascertain the first reference measured value, and a second magnetic field measurement is carried out using the magnetic field sensor while an object is situated in the measuring range of the magnetic field sensor to ascertain the second reference measured value.

3. The method as recited in claim 1, wherein the computed distances are normalized, a difference between the two normalized distances is computed, the difference between the two normalized distances is compared to a sensor unit activation threshold value, and the deactivated sensor unit is activated based on the comparison to the sensor unit activation threshold value.

4. The method as recited in claim 3, wherein the normalized distances are compared to a threshold value, it being ascertained, based on the comparison to the threshold value, whether an object is situated in the surroundings of the sensor device.

5. The method as recited in claim 1, wherein when it is ascertained, based on the sensor data, that an object is situated in the surroundings of the sensor device, a magnetic field measurement is carried out with the aid of the magnetic field sensor in order to update the second reference measured value, and when it is ascertained, based on the sensor data, that the surroundings of the sensor device are free of an object, a magnetic field measurement is carried out with the aid of the magnetic field sensor in order to update the first reference measured value.

6. The method as recited in claim 1, wherein a result of ascertaining whether an object is situated in the surroundings of the sensor device is transmitted via a communications network.

7. The method as recited in claim 1, wherein the sensor device is situated in surroundings of a parking position so that, based on a result of ascertaining whether an object is situated in the surroundings of the sensor device, it is ascertained whether the parking position is available or occupied.

8. The method as recited in claim 1, wherein the sensor unit includes at least one of a radar unit and an ultrasonic unit.

9. A sensor device for detecting an object, comprising:

a magnetic field sensor;

a sensor unit designed for a propagation time measurement;

a control device for controlling the magnetic field sensor and the sensor unit; and a processor;

wherein the control device is designed for controlling the magnetic field sensor in such a way that a magnetic field in surroundings of the sensor device is measured using the magnetic field sensor to ascertain a measured value that corresponds to the measured magnetic field, the sensor unit being deactivated during the measurement of the magnetic field;

wherein the processor is designed for computing a first distance of the measured value from a first reference measured value that corresponds to a magnetic field when a measuring range of the magnetic field sensor is free of an object;

wherein the processor is designed for computing a second distance of the measured value from a second reference measured value that corresponds to a magnetic field when an object is situated in the measuring range of the magnetic field sensor;

wherein the control device is designed for activating the deactivated sensor unit as a function of the computed distances, and controlling it in such a way that a propagation time measurement is carried out in the surroundings of the sensor device with the aid of the activated sensor unit to ascertain sensor data that correspond to the propagation time measurement; and wherein the processor is designed for ascertaining, based on the sensor data, whether an object is situated in the surroundings of the sensor device.

10. The sensor device as recited in claim 9, wherein the control device is designed for controlling the magnetic field sensor in such a way that a first magnetic field measurement is carried out using the magnetic field sensor while a measuring range of the magnetic field sensor is free of an object to ascertain the first reference measured value, and the control device is designed for controlling the magnetic field sensor in such a way that a second magnetic field measurement is carried out using the magnetic field sensor while an object is situated in the measuring range of the magnetic field sensor to ascertain the second reference measured value.

11. The sensor device as recited in claim 9, wherein the processor is designed to normalize the computed distances, compute a difference between the two normalized distances, and compare the difference between the two normalized distances to a sensor unit activation threshold value, the control device being designed to activate the deactivated sensor unit based on the comparison to the sensor unit activation threshold value.

12. The sensor device as recited in claim 11, wherein the processor is designed to compare the normalized distances to a threshold value, and by the comparison to the threshold value, ascertain whether an object is situated in the surroundings of the sensor device.

13. The sensor device as recited in claim 9, wherein the control device is designed to control the magnetic field sensor in such a way that a magnetic field measurement is carried out use the magnetic field sensor to update the second reference measured value when it is ascertained, based on the sensor data, that an object is situated in the surroundings of the sensor device, and the control device is designed to control the magnetic field sensor in such a way that a magnetic field measurement is carried out using the magnetic field sensor to update the first reference measured value when it is ascertained, based on the sensor data, that the surroundings of the sensor device are free of an object.

14. The sensor device as recited in claim 9, wherein a communication interface is provided which is designed to transmit via a communications network a result of ascertaining whether an object is situated in the surroundings of the sensor device.

15. The sensor device as recited in claim 9, wherein an electrical energy supply is provided for supplying electronic elements of the sensor device with electrical energy.

16. The sensor device as recited in claim 9, wherein the processor is designed for ascertaining whether a parking position is available or occupied, based on a result of ascertaining whether an object is situated in the surroundings of the sensor device.

17. The sensor device as recited in claim 9, wherein the sensor unit includes at least one of a radar unit, and an ultrasonic unit.

18. A non-transitory computer readable storage medium storing a computer program that includes program code for operating a sensor device for detecting an object, the sensor device including a magnetic field sensor, and a sensor unit that is designed for a propagation time measurement, the program code, when executed by a computer, causing the computer to perform:

measuring a magnetic field in surroundings of the sensor device using the magnetic field sensor to ascertain a measured value that corresponds to the measured magnetic field, the sensor unit being deactivated during the measurement of the magnetic field;

computing a first distance of the measured value from a first reference measured value that corresponds to a magnetic field when a measuring range of the magnetic field sensor is free of an object;

computing a second distance of the measured value from a second reference measured value that corresponds to a magnetic field when an object is situated in the measuring range of the magnetic field sensor;

activating the deactivated sensor unit as a function of the computed first distance and the computed second distance;

carrying out a propagation time measurement in the surroundings of the sensor device using the activated sensor unit to ascertain sensor data that correspond to the propagation time measurement; and ascertaining, based on the sensor data, whether an object is situated in the surroundings of the sensor device.

* * * * *